United States Patent [19]

Desilets et al.

[11] 3,999,753

[45] Dec. 28, 1976

[54] BALL STRIKING PRACTICE DEVICE WITH BALL DISPENSING APPARATUS

[75] Inventors: Joan Desilets, Sucasunna; Odd Oddsen, Morristown, both of N.J.

[73] Assignee: Motion Unlimited, Inc., Mountain Lakes, N.J.

[22] Filed: Oct. 29, 1974

[21] Appl. No.: 518,385

[52] U.S. Cl. ..... 273/29 A; 124/41 R; 124/50; 221/298; 273/201

[51] Int. Cl.[2] ..... A63B 69/38

[58] Field of Search ..... 273/29 R, 29 A, 33, 273/201, 202, 26 R, 1.5 A; 124/50, 51, 52, 45, 49, 41; 221/298

[56] References Cited

UNITED STATES PATENTS

| | | | |
|---|---|---|---|
| 2,295,599 | 9/1942 | Mozel | 273/201 |
| 2,335,280 | 11/1943 | Hogeberg | 273/33 |
| 2,939,705 | 6/1960 | McCall | 273/1.5 A |
| 3,470,859 | 10/1969 | Ponza | 124/50 X |

FOREIGN PATENTS OR APPLICATIONS

| | | | |
|---|---|---|---|
| 25,882 | 6/1931 | Australia | 124/16 |

*Primary Examiner*—Richard C. Pinkham
*Assistant Examiner*—T. Brown
*Attorney, Agent, or Firm*—Morgan, Finnegan, Pine, Foley & Lee

[57] ABSTRACT

A tennis ball dispensing device for practicing tennis strokes that includes an inclined tubular chute for retaining and delivering balls to a flexible sock having an opening therein for permitting release of a ball therethrough, the sock being suspended from a pivotal ring located at the lower end of the chute. The balls move to the end of the chute under the force of gravity and are delivered into the sock to be releasably held therein as a result of the racket's striking the ball held in the sock, the ball being driven from the sock as a result of the racket striking the sock and ball. A ball escape indexing mechanism releases one ball at a time into the net as a result of pivoting of the ring when the ball and sock are struck by the racket.

21 Claims, 7 Drawing Figures

BALL STRIKING PRACTICE DEVICE WITH BALL DISPENSING APPARATUS

BACKGROUND OF THE INVENTION

This invention relates to devices for enabling a player to practice striking a ball. Specifically, it relates to an improved device for positioning a ball, particularly a tennis ball, in a position desired by the player and for automatically delivering succeeding balls to the same position after each ball is struck by the player.

An important objective of the present invention is to provide a device which may be used by tennis players for practicing the various strokes of the game, i.e., backhand, forehand and serve, by striking a stationary ball. This form of practice is beneficial not only for beginners who are learning to connect the racket with the ball but also for experienced players at various levels who wish to improve their judgment of proper body placement relative to the ball.

A number of mechanical devices have been used or proposed for enabling players of moving ball games, of which baseball and tennis are examples, to attain skill in hitting the ball. And such apparatus, as a rule, are truly useful only when the player can practice hitting a succession of balls repeatedly at close intervals. Machines which have been developed for projecting the ball toward the player at various angles and velocities accomplish this function, but they are, of course, expensive and also require the player to move to and connect with a ball which is traveling toward, and possibly to the "inside" or "outside" of the player's stroke, as well. The invention is not concerned with this type of device. Rather, as noted above, the primary object and advantage of the invention is to deliver balls in succession as the player is ready for them at a preselected position where the ball may be struck and projected toward a desired target.

Several mechanical contrivances have been suggested for accomplishing this object. They are, however, far from satisfactory. One of these holds a ball rigidly at the end of a collapsible, vertical stand. When the ball (which is permanently affixed to the stand) is struck by the player, the stand collapses or pivots forwardly and then automatically returns to its upright position for striking again. While apparatus of this type gives the player a target to strike at, he is given little opportunity to judge the correctness of his stroke and aim because the ball cannot be projected. So far as we are aware, there are no satisfactory devices previous to the invention which accomplish the function of holding the ball stationary in a position where it can be struck and projected by the player to the point of aim.

Batting practice devices of the type disclosed in U.S. Pat. Nos. 2,955,823 and 2,955,824 represent another approach. These devices, however, not only cannot be used for tennis stroking practice but are also disadvantageous in that they require the player to make special motions unrelated to the desired exercise in order to release each ball as it is needed. In other words, release of the ball to the practice position is not automatic; moreover, it is possible to accidentally release more than one ball. Devices of this type cannot be used for tennis practice because the ball is delivered down a wire formation which interferes with the stroke of the tennis racket at and "through" the tennis ball.

It is accordingly a primary object of the invention to provide a device that is useful, particularly in the game of tennis, squash and the like, for practicing hitting the ball wherein the ball may be driven by the racket to the point of aim.

A further object of the invention is to provide a ball striking practice device in which the balls are delivered one by one automatically as each ball is hit.

Yet another object of the invention is to provide a ball striking practice device which may be adjusted to various positions and which may be used for practicing all of the basic racket strokes, while permitting the racket to swing through the point of impact with the ball and allowing the ball to be projected.

SUMMARY OF THE INVENTION

In brief, these and other objects are attained by a device wherein a magazine, which may be disposed in an inclined position, holds and supplies a number of balls to a discharge opening. A ball delivery mechanism controls the release of balls, one by one, into a flexible member, e.g., in the form of a sock disposed beneath the discharge opening of the magazine, such that released balls are caught and suspended at the desired position for striking by the player. In the preferred embodiment the delivery mechanism includes an escape member which normally blocks the release of the ball through the discharge opening but is momentarily movable out of the path of the ball when the ball is struck and projected out of the flexible member, whereupon a stop member of the mechanism is momentarily moved into the path of succeeding balls so that only one ball at a time falls into the flexible member. The flexible member and magazine may be vertically adjustable to accommodate all players and the various strokes.

BRIEF DESCRIPTION OF THE DRAWINGS

A better understanding of the invention will be gained from the following detailed description of the preferred embodiment, together with the drawings in which.

DESCRIPTION OF THE PREFERRED EMBODIMENT

Figures 1, 1A:
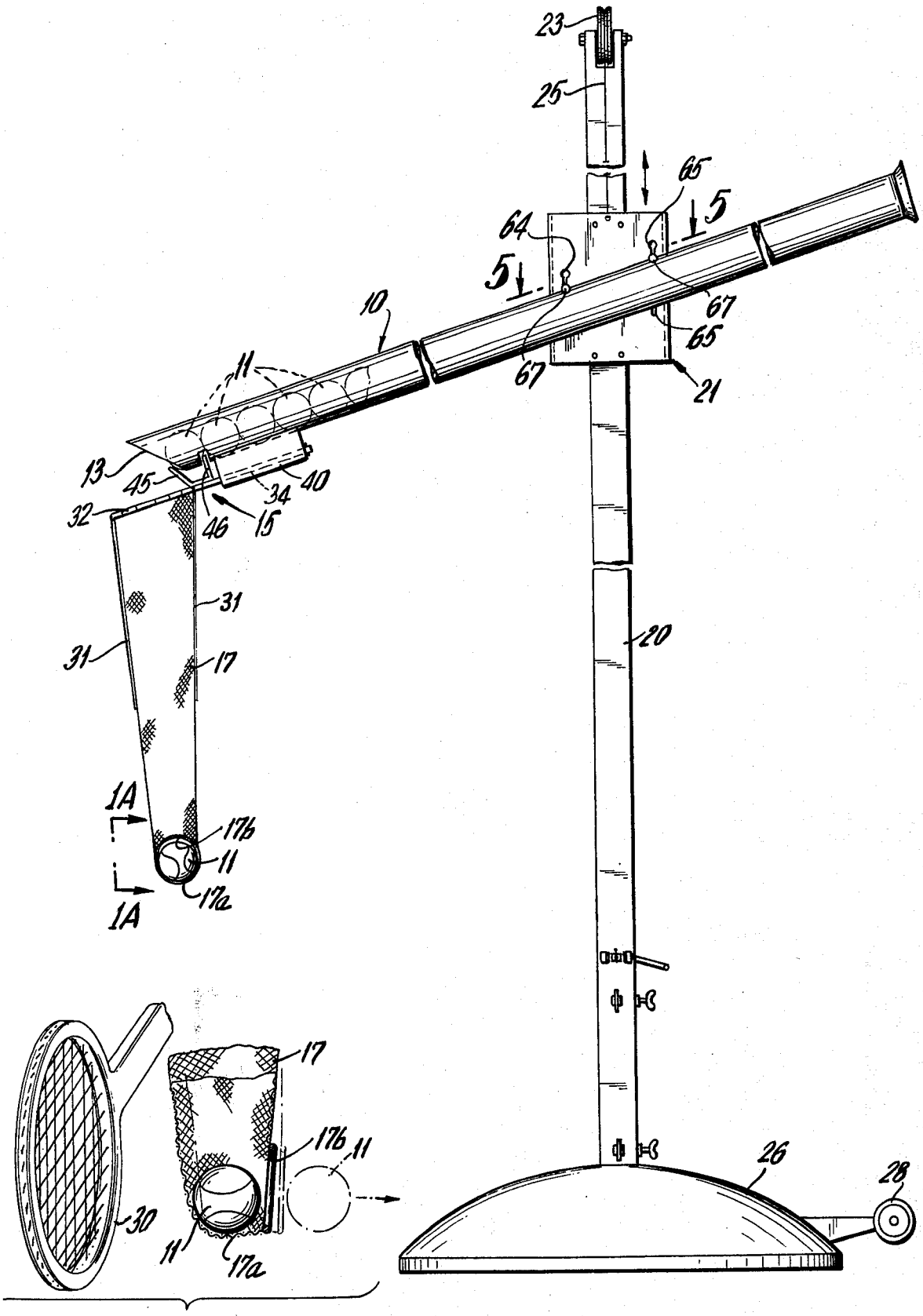
FIG. 1 is a side elevation view of an apparatus according to the invention.
FIG. 1A is a view through the flexible sock element of the device taken along the line 1A—1A of FIG. 1.

Referring first to FIG. 1, all of the elements of the invention can be seen, as viewed from a point toward which the balls would be projected when struck. The fundamental elements include a hollow tubular magazine 10 for holding and supplying a plurality of tennis balls 11 to a discharge opening 13 at the lower end of the magazine. A ball delivery mechanism, indicated generally by the numeral 15, controls the release of the tennis balls so that they are discharged one by one into a flexible, or pliant, ball-receiving sock 17 which catches and suspends the discharged ball.

The magazine 10 is supported on a vertical stand 20 by means of a slidable carriage 21, which if free to move up and down the vertical post 20. For this purpose, a pulley 23 at the upper end of the post guides a cable 25 attached to the supporting slide 21 over the top of the post and then down to a crank (not shown) or other suitable mechanism for raising and lowering the magazine 10 to any desired height from the ground. The magazine may be dimensioned as long as desired and constructed from a strong, lightweight material such as aluminum or plastic. The longer the magazine, the more balls can be stored within it; a length which can accommodate three dozen tennis balls has been found to be sufficient for most practice exercises. The vertical post itself extends upwardly from a weighted base 26 having a pair of horizontally extending casters 28 by which the entire device may be tilted backwardly and rolled on the casters for movement from one location to another.

FIG. 1A shows details of the lower extremity of the sock 17. When the ball is discharged through the opening 13 of the magazine, it falls to the bottom of the sock (even though the ring during this period of time is rotated in an angular position displaced from that shown in FIG. 1). It is therefore caught and suspended in the position (which is adjustable by adjusting the height of the slide 21) desired by the player for practicing his strokes. In the lower portion 17*a* of the sock is an opening 17*b* that is dimensioned so as to permit the ball to be driven through it (as indicated by the phantom lines) in the direction of the arrow when struck by the racket 30. In the drawing the opening is shown to be located in the side of the sock, but in some cases it may be preferred to locate the opening 17*b* in the bottom of the sock to improve the accuracy of the ball's trajectory. In this case, the opening is dimensioned to be slightly smaller in diameter than the ball, while permitting passage of the ball therethrough when struck, due to the stretch characteristic of the sock material.

Preferably, the sock is constituted of a net-like material, which can be made from any suitable synthetic or natural yarn such as nylon, polyester, cotton, etc. This enables the sock to yield with the force of the racket without impeding the player's strokes. At the same time, the ball is permitted to be driven toward the point of aim, thus enabling the player to judge the correctness of his technique and the accuracy of his swing.

Referring again momentarily to FIG. 1, it is observed that the sock is provided with vertical spines 31 of flexible stiffening material attached to the sock and extending partway down its length. The spines serve to preclude the sock from wrapping about the magazine 10 after being struck and aid in returning the sock to its normal position for receiving the next ball. In a related connection, it should be pointed out that the sock performs the dual function of yieldably and releasably suspending the ball and of transmitting the force of the racket to the ball delivery mechanism. Accordingly, any element which functions in this manner may be used, so long as it does not appreciably impede movement of the racket through the point of suspension of the ball.

Figure 2:
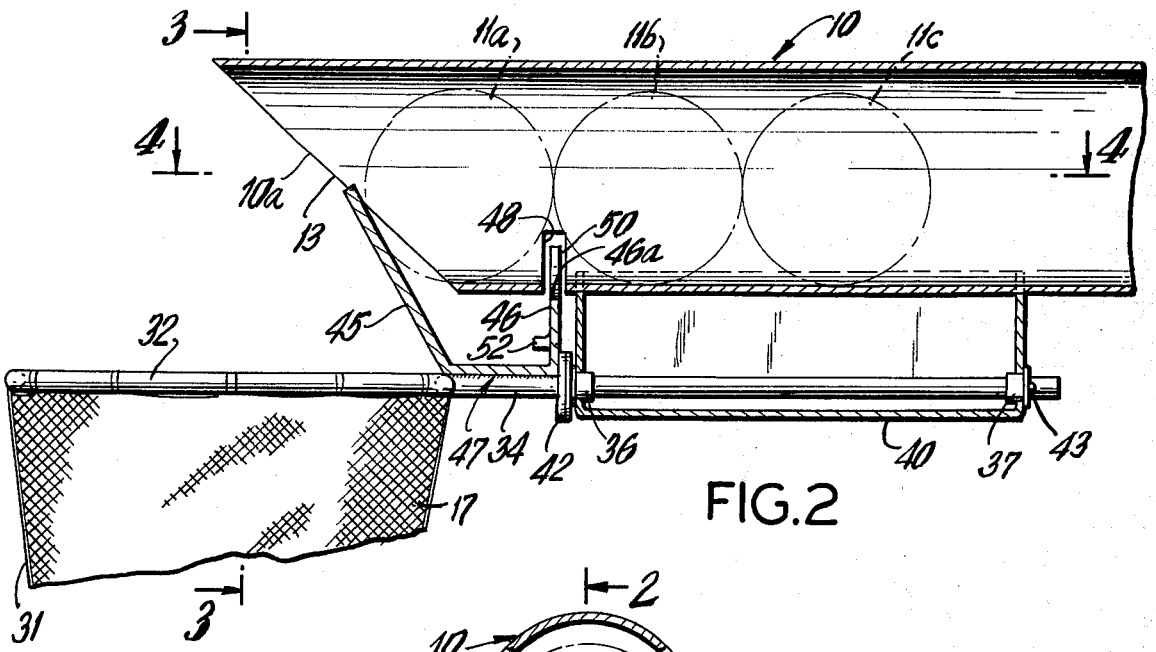
FIG. 2 is a side view in cross-section of the forward end of the apparatus, taken along the line 2—2 of FIG. 3 and showing details of the ball delivery mechanism.
Figure 3:
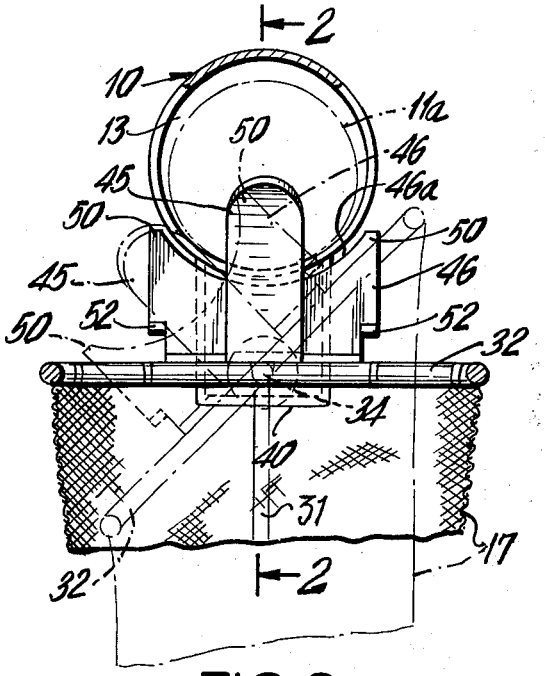
FIG. 3 is a front view in partial cross-section taken along the line 3—3 of FIG. 2.
Figure 4:
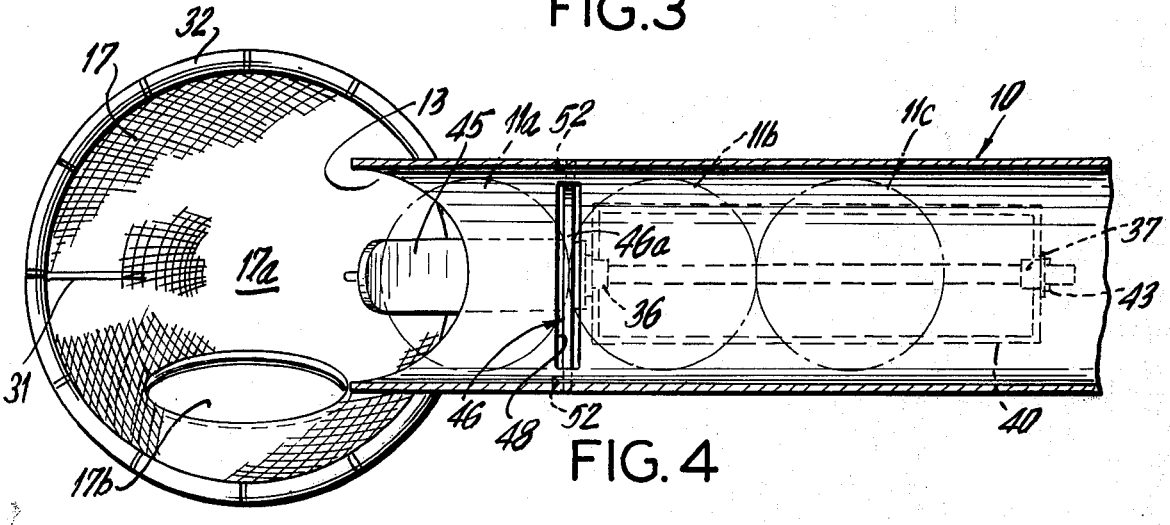
FIG. 4 is a plan view of the ball delivery mechanism taken generally along the line 4—4 of FIG. 2.

The details of the ball release mechanism are best seen from FIGS. 2–4. Referring first to FIG. 2, it is seen that the discharge end 10*a* of the hollow tubular magazine is truncated to ensure reliable discharge of the tennis balls 11*a–11c* situated seriatim in the magazine and being discharged one-by-one after each ball is struck from the sock 17.

The sock 17 is suspended from a ring 32 which is formed integrally with a rotatable shaft 34 whose axis extends parallel to the axis of the magazine 10. This shaft 34 is journaled for rotation in either direction in a pair of nylon bushings 36, 37 carried at opposite ends of a U-shaped bracket 40 joined to the underside of the magazine 10. The ring 32 is maintained in axial alignment with the discharge opening 13 by the spacing washer 42 at the forward end of the bracket 40 and by a pin 43 at the opposite end of the bracket. When the racket strikes the ball suspended in the sock 17, sufficient force is generated to cause the ring 32 to pivot, and the shaft 34 to rotate, from the normal position to the release position indicated by the phantom lines in FIG. 3. This action results in the automatic release of the next ball in the magazine, in the manner now described.

The ball delivery mechanism 15 includes a ball escape member 45 and a ball stop member 46 which together operate to release a single ball each time the racket strikes the ball suspended in the sock. As best observed from FIGS. 3 and 4, the stop member 46 may be formed integrally with the escape member 45 from a single piece of formed sheet metal. The escape member 45 is inclined in the forward direction and projects into the path of the ball 11*a* immediately adjacent the discharge opening when the ring 32 is in the normal position. Both members 45, 46 and rigidly affixed to the ring 32 and shaft 34 and are rotatable therewith between the normal position and the release position.

From FIG. 3, it is seen that the upper edge 46*a* of the stop member is contoured to conform to the tubular magazine 10 but has edge portions 50 which move momentarily through the transverse slot 48 (FIG. 2) into the path of the succeeding ball 11*b* when the ring is rotated to the release position. This prevents the ball 11*b* and all balls behind it from rolling forward under the force of gravity. The release member 45, on the other hand, rotates out of the path of the forward-most ball 11*a*, permitting it to drop into the sock. The inertia of the system is such that sufficient time is given for the ball 11*a* to be released before the ring returns to the normal position. Upon return of the ball delivery mechanism to the normal position (solid lines in FIG. 3), all remaining balls in the ball carrier 10 move forward until the forward-most ball contacts the release member 45. Thus the balls 11*b*, 11*c* move into the positions formerly occupied by the balls 11*a*, 11*b*, respectively.

Rotational movement of the ball delivery mechanism is restricted to predetermined limits by the stop tabs 52 projecting forwardly from each side of the stop member. When the ball delivery mechanism is put into its fully displaced position, as indicated by the phantom lines of FIG. 3, the stop members 52 contact the wall of the tubular magazine 10.

We have found that the apparatus, as described herein, works reliably and satisfactorily without the aid of any further elements. Nevertheless, it is possible, should it be desired to regulate the mechanical time constant of the ball delivery mechanism, to provide a mild resilient force for returning the ball delivery mechanism to the normal position following release of the ball. For this purpose, a tortional spring reacting, for example, between the shaft 34 and the support bracket 40 might be employed. Likewise, suitable damping might also be used, it being recognized that it is desirable to minimize resistance to the motion of the racket as it strikes the ball-receiving sock 17. To a certain extent, control of this factor can be achieved by maintaining at least the lower portion of the sock pliant and light in weight.

Figure 5:
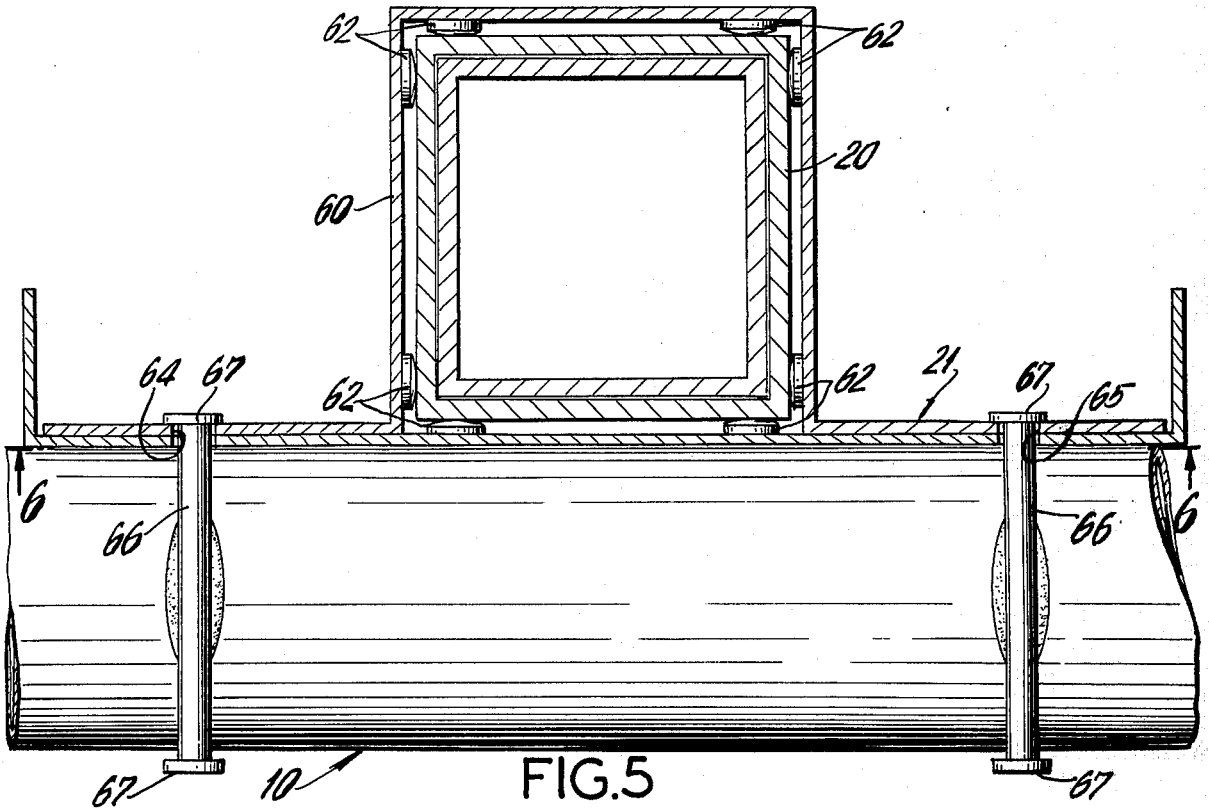
FIG. 5 is a cross-sectional view taken generally along line 5—5 of FIG. 1 showing details of the support stand and magazine slide of the apparatus.
Figure 6:
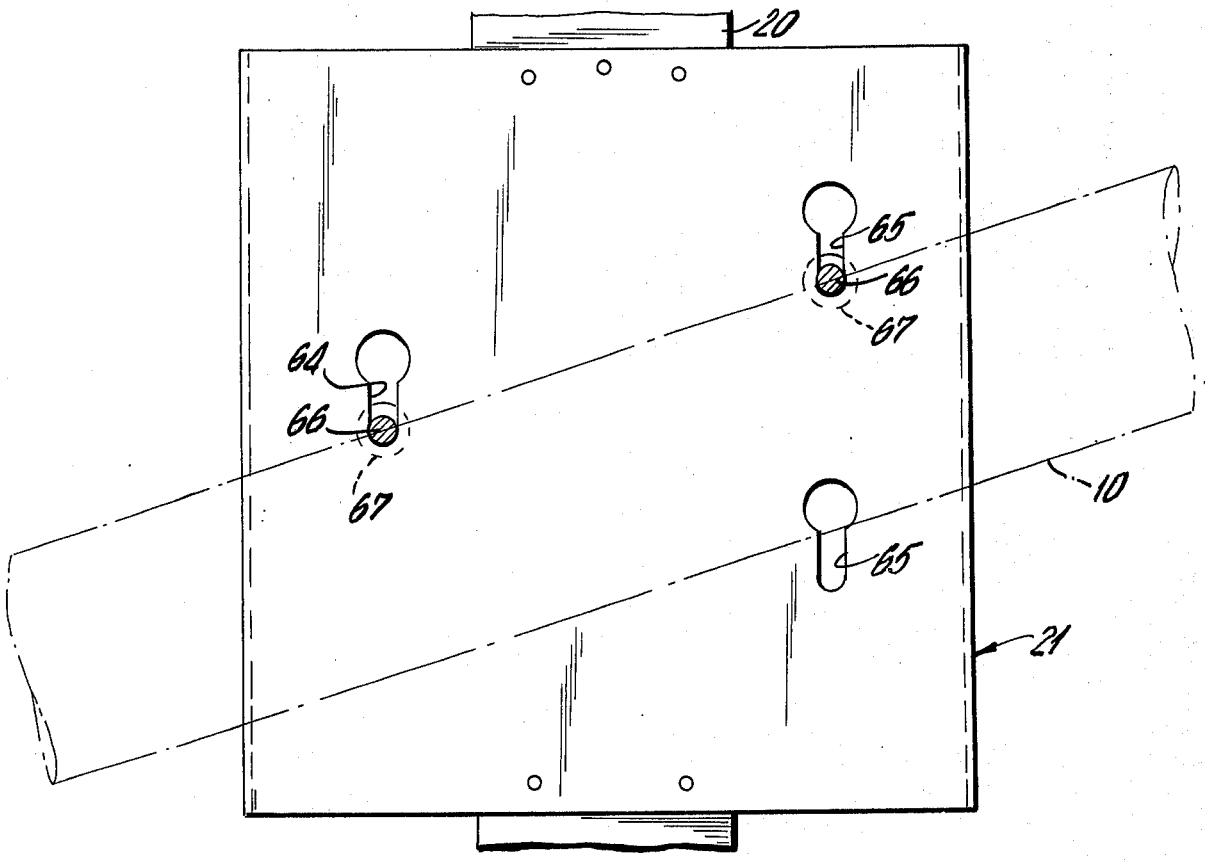
FIG. 6 is a front elevation view along the line 6—6 of FIG. 5.

Turning now to FIGS. 5 and 6, the manner of supporting the tubular magazine by means of the slide 21 is better seen. The support stand 20 is indicated as rectangular in cross-section; however, it should be understood that other cross-sectional forms may be used such as a longitudinally grooved round post. The slide 21 includes a bracket member 60 conforming to the contour of the stand's cross-section and, on its inside surface, is provided with a series of nylon bearings 62 which ride against the outer surface of the stand 20 as the slide 21 moves up and down. The bearings 62 also serve to keep the slide properly positioned and prevent it from swinging about the axis of the stand.

The bracket 60 is provided with three keyhole slots, a slot 64 on the left and two vertically displaced slots 65 on the right (FIG. 6). Welded to the tubular magazine 10 are a pair of pins 66 having enlarged heads 67 at each end thereof. One of these fits into the slot 64, and the other fits into one of the slots 65. The distance between the keyholes 65 is such that a suitable angle of incline (e.g., 18°) permitting gravitational feed of the balls is maintained. Since the pins 66 extend transversely beyond the magazine 10 at either end, the magazine can be manually lifted up and out of the keyholes 64 and turned around so that the lower end of the magazine points to the right rather than to the left.

Although the invention has been described with reference to a specific embodiment, it should be understood that certain modifications and variations within the skill of the art may be made without departing from the spirit and scope of the invention. Accordingly, the invention should not be taken as restricted to the precise embodiment disclosed.

What we claim is:

1. A ball dispensing practice device for tennis and the like, comprising:

a magazine for holding and supplying a plurality of forwardly biased balls to a discharge opening thereof;

a ball delivery mechanism having escape and stop members spaced apart in the direction of the path of the balls held in the magazine, the delivery mechanism being pivotal between a normal position, wherein the stop member is free of said ball path and the escape member contacts and prevents the release of the ball adjacent the discharge opening, and a release position wherein the escape member is free of the ball path to permit discharge of the first ball and the stop member projects into the ball path to prevent the release of balls upstream thereof;

yieldable ball receiving means supported below the discharge opening of the magazine for receiving and releasably holding a discharged ball in a desired position for striking, said ball receiving means being yieldably movable out of the path of an object striking a discharged ball without substantially changing the path of such object when the object causes the ball to be released from said ball receiving means; and means mechanically coupling the ball receiving means to the delivery mechanism for causing said mechanism to pivot under the force generated when the ball in the yieldable ball receiving means is struck.

2. The ball dispensing device of claim 1, wherein;

the magazine is a hollow tubular member; and the ball delivery mechanism is supported by the magazine for rotation about an axis generally parallel to said hollow tubular member;

said tubular member having a transverse opening in the wall thereof adjacent the delivery mechanism whereby, upon rotation of said mechanism, the ball stop member rotates through said opening into the path of balls in the tubular member.

3. A ball striking practice device, comprising:

a magazine adapted for support in an inclined position when in use for holding and supplying to a discharge opening at the lower end thereof a plurality of balls;

a ball delivery mechanism carried by the magazine having escape and stop members for delivering balls seriatim to the discharge opening, said escape member normally blocking release of the ball adjacent the discharge opening but being momentarily movable out of the path of said ball to release it out of the discharge opening, said stop member being momentarily movable into the path of succeeding balls in the magazine during discharge of the ball adjacent the opening;

a flexible member disposed beneath the discharge opening for catching and releasably suspending the discharged ball in a position for striking by a player, said flexible member being flexible generally in the direction of movement of an object striking a ball suspended therein and being connected to the ball delivery mechanism for transmitting an actuating force to the ball delivery mechanism when a ball suspended by said flexible member is struck, thereby to cause release of the suspended ball and momentary movement of the escape and stop members so as to discharge a further ball from said magazine, such that said flexible member is yieldably movable out of the path of an object striking a suspended ball when the object causes the ball to be released from said flexible member.

4. The ball striking practice device of claim 3, further comprising:

a vertical post; and means slidably mounting the magazine on the post for adjustable vertical movement thereon.

5. The ball striking practice device of claim 3, wherein:

the flexible member comprises a sock having an opening at the lower end thereof through which the ball may be projected when struck.

6. The ball striking practice device of claim 3, wherein:

the ball escape and stop members are spaced apart in the direction of the axis of the magazine and are rotatable together about an axis parallel thereto.

7. The ball striking practice device of claim 6, wherein:

the rotatable ball escape and stop members are angularly displaced in the direction of rotation so that when one of said members blocks the movement of balls in the magazine, the other member is external of the path of the balls so as to permit forward movement of the balls therein.

8. The ball striking practice device of claim 7, wherein:

the magazine is tubular and has a transverse slot through a portion of the wall thereof, and the ball stop member is rotatable through said slot into and out of the path of balls within the magazine.

9. The ball striking practice device of claim 7, wherein the ball delivery mechanism comprises:

a ring disposed beneath the discharge opening for carrying the flexible ball catching member;

a rotatable shaft connected to the ring and extending outside the magazine parallel to the axis thereof;

the escape and stop members being connected to the shaft so as to rotate therewith when the ring rotates.

10. A tennis practicing device comprising:

a support stand;

a ball carrier having a discharge end and an opening thereat mounted on said stand for holding and supplying a plurality of forwardly biased tennis balls to said discharge end of the carrier;

a ball-suspending member disposed below the discharge end of the carrier for catching and releasably suspending each ball discharged from the carrier at a predetermined desired location for striking by a player's racket, said ball-suspending member being yieldably movable out of the path of the racket striking a ball suspended thereby;

a ball delivery mechanism associated with the carrier and being momentarily movable from a normal position, wherein the forward movement of balls through the discharge opening is blocked by said mechanism, to a release position wherein the ball adjacent the discharge end is released while the forward movement of the succeeding ball is blocked; and means connecting the ball-suspending member to the ball delivery mechanism for causing movement thereof between the normal and release positions upon movement of the ball-suspending member when the ball is struck.

11. The tennis practice device of claim 10, wherein:

the ball release mechanism is biased into the normal position and is rotatable between said normal and release positions, said mechanism including a ball escape member normally blocking the path of balls in the magazine and a stop member normally free of the ball path, the escape and stop members being momentarily movable out of and into the ball path, respectively, so as to permit the release of the forward-most ball and prevent the forward motion of the succeeding ball.

12. The tennis practice device of claim 11, wherein the ball carrier is a hollow tubular member having a transverse opening therein; and the stop member is rotatable into the path of the succeeding ball through said transverse opening.

13. The tennis practice device of claim 10, wherein the ball suspending element is a sock of pliant material having a hole in the lower portion thereof through which the ball may be driven when struck.

14. A ball striking practice device, comprising:

a magazine for holding and supplying seriatim a plurality of forwardly biased balls to a discharge opening therein;

a flexible receptacle disposed to receive and releasably suspend each ball discharged from the opening at a desired position for striking by the user, said flexible receptacle being flexible generally in the direction of movement of an object striking a ball suspended therein such that said flexible receptacle is yieldably movable out of the path of an object striking the suspended ball the object causes the ball to be released from said flexible receptacle; and ball release means coupled to the magazine and to the flexible receptacle for releasing a single ball through the discharge opening in response to movement of the flexible receptacle upon each striking of a suspended ball.

15. The ball striking practice device of claim 14, wherein:

the magazine is disposed at an incline so as to gravitationally bias the balls carried thereby in a forward direction.

16. The ball striking practice device of claim 15, further comprising:

means for adjusting the vertical position of the receptacle relative to the ground.

17. The ball striking practice device of claim 15, wherein:

the flexible receptacle comprises a pliant sock-like member disposed beneath the discharge opening for catching the discharged ball and having an opening therein through which the ball may be driven when struck.

18. A ball dispensing practice device for tennis and the like, comprising:

a magazine for holding and supplying a plurality of gravitationally forwardly biased balls to a discharge opening, therein;

a ball delivery mechanism having release and stop members spaced apart in the direction of the path of the balls held in the magazine, the delivery mechanism being pivotal between a normal position, wherein the stop member is free of the ball path and the escape member contacts and prevents the release of the ball adjacent the discharge opening, and a release position wherein the escape member is free of the ball path to permit gravity discharge of the first ball and the stop member projects into the ball path to prevent the release of balls upstream thereof;

a flexible sock suspended beneath the discharge opening for receiving and holding the discharged ball in a desired position for striking, the sock having an opening through which the ball can be projected when struck; and a mechanical coupling element connected to the delivery mechanism and supporting the flexible sock for causing said mechanism to pivot when the ball in the sock is struck.

19. A ball striking practice device, comprising:

a magazine for holding and supplying seriatim a plurality of balls to a discharge opening therein;

means supporting the magazine at a desired height above the ground;

yieldable ball receiving means disposed beneath the discharge opening of the magazine for catching and releasably suspending a discharged ball at a desired position above the ground for striking by the user, said ball receiving means being yieldably movable out of the path of an object striking a suspended discharged ball without substantially changing the path of such object when the object causes the ball to be released from said ball receiving means and being formed to permit the ball to be driven therefrom upon being struck; and a ball discharge mechanism associated with the magazine for singly releasing balls into said ball receiving means.

20. The ball striking practice device of claim 19, wherein:

said ball receiving means comprises a vertically oriented sleeve of pliant material having an opening through which the ball may be driven when struck.

21. The ball striking practice device of claim 19, further comprising:

means mechanically coupling said ball receiving means to the ball discharge mechanism, the mechanism being operable in response to movement of the ball receptacle as the ball suspended thereby is struck.

* * * * *